US006158177A

United States Patent [19]

Blöbaum

[11] Patent Number: 6,158,177

[45] Date of Patent: Dec. 12, 2000

[54] CLAMPING MOUNTING FOR GLASS PLATES, AND A KIT TO CONSTRUCT A CLAMPING MOUNTING TO MOUNT GLASS PLATES, AND A METHOD TO UTILIZE A KIT TO CONSTRUCT A CLAMPING MOUNTING TO MOUNT GLASS PLATES

[75] Inventor: Ernst Udo Blöbaum, Leopoldshöhe, Germany

[73] Assignee: Dorma GmbH + Co. KG, Ennepetal, Germany

[21] Appl. No.: 09/200,459

[22] Filed: Nov. 25, 1998

Related U.S. Application Data

[63] Continuation-in-part of application No. PCT/EP98/01705, Mar. 24, 1998.

[30] Foreign Application Priority Data

Mar. 27, 1997 [DE] Germany ..... 197 13 038

[51] Int. Cl.[7] ..... E06B 3/00

[52] U.S. Cl. ..... 52/208; 52/204.62; 52/204.63; 411/384

[58] Field of Search ..... 52/208, 204.62, 52/204.65, 204.63, 204.68, 202, 203, 585.1, 582.1; 411/535, 536, 546, 383, 384, 396, 397, 366.1, 369

[56] References Cited

U.S. PATENT DOCUMENTS 4,689,928 9/1987 Dutton et al. .

FOREIGN PATENT DOCUMENTS

| | | |
|---|---|---|
| 0192472 | 8/1986 | European Pat. Off. . |
| 0506522 | 9/1992 | European Pat. Off. . |
| 0617190 | 9/1994 | European Pat. Off. . |
| 7705090 | 6/1977 | Germany . |
| 3328338 | 2/1985 | Germany . |
| 9318862 | 5/1995 | Germany . |
| 4436483 | 4/1996 | Germany . |
| 2171137 | 8/1986 | United Kingdom . |

*Primary Examiner*—Carl D. Friedman
*Assistant Examiner*—Kevin McDermott
*Attorney, Agent, or Firm*—Nils H. Ljungman & Associates

[57] ABSTRACT

A clamping mounting for glass plates uses an attachment bolt which passes through a bore in the glass plate and comprises a head and a barrel. The head and the barrel are realized as separate components whose axes can be displaced relative to one another and which can be axially fixed relative to one another. An adjusting nut has a slot-like groove in which a retaining flange of the attachment bolt is seated, the floor of which groove forms a support flange for the retaining flange and has a slot which guides, and through which passes, the barrel of the attachment bolt.

20 Claims, 4 Drawing Sheets

A
25
11
10
12
21
A 20
23
25
15

12
37

12
25
10

11
21

6
17
19

CLAMPING MOUNTING FOR GLASS PLATES, AND A KIT TO CONSTRUCT A CLAMPING MOUNTING TO MOUNT GLASS PLATES, AND A METHOD TO UTILIZE A KIT TO CONSTRUCT A CLAMPING MOUNTING TO MOUNT GLASS PLATES

This appln is a C-I-P of PCT/EP98/01705 filed Mar. 24, 1998.

BACKGROUND OF THE INVENTION

1. Field of the Invention

The present invention relates to a clamping mounting for glass plates, comprising an attachment bolt which passes through a bore in the glass plate and has a head and a barrel.

2. Background Information

Bores in glass plates are commonly used to join glass plates to form large-area glass facades or to attach glass plates to suitable supporting elements. Because the aforementioned bores and also the fastening or connecting elements which engage in or pass through the bores are subject to certain manufacturing tolerances, bringing the bore in the glass plate into flush alignment with the axis of the fastening or clamping element is a common problem. If the connection between the glass plate and the fastening or supporting element permits, these tolerances can be compensated for with the fastening or supporting element.

German Utility Model 77 05 090 discloses a clamping mounting for all-glass structures in which a clamping rail is used to connect adjacent glass plates and in which tolerance compensation is realized by means of bores in the clamping rail of sufficient size so as to allow sufficient lateral play for the nut of the attachment bolt.

European Patent Application 0 617 190 A1 discloses a connection between two adjacent glass plates in which the clamping rail is at some distance to the glass plate and the barrel of the attachment bolt is mounted in a spherical head in the clamping rail.

U.S. Pat. No. 4,689,928 teaches a similar solution to tolerance compensation; here the socket member is located directly in the bore in the plate. To realize effective tolerance compensation, the supporting element connected to the socket element must be of a correspondingly complex design having joints which can flex relative to one another.

German Utility Model 93 18 862 teaches a method of tolerance compensation between the bores in the separate panes of a multi-pane glass plate. Relatively large diameter bores are made in the outer as well as the inner panes. During installation, the bore surrounding the actual attachment bolt is filled with cast resin. Such large bores are aesthetically undesirable and the required use of cast resin makes installation correspondingly complex.

European Patent Application 0 506 522 B1 teaches a method of tolerance compensation in which eccentric rings which can be turned relative to one another are inserted into, and partially line, the bores in the glass plates. Installation is complex here as well, as the rings must be inserted into the bore with zero play.

German Patent No. 33 28 338 C3 discloses a device for moving a first component relative to a second component, which device could be used for connecting adjacent exterior door panels of motor vehicles, for example. Adjacent components are moved relative to one another by screwing a distance bush on which the first component is mounted into the second component. The second component is either equipped with a threaded bolt or itself forms a corresponding flange into which the distance bush can be screwed. Because at least the second component must have a flange-like prolongation, such a device is unsuitable for interconnecting glass plates or attaching glass plates to suitable supporting elements.

Finally, German Patent No. 44 36 483 A1 discloses an attachment device for attaching building panels, in which the bolt used to attach the panel is mounted in a through bore in the panel to permit spherical pivoting motion. This is realized by means of clamping jaws which are mounted flush on both sides of the panel and can be bolted together. The clamping jaws themselves have dome shaped supporting surfaces against which the bolt is indirectly propped via a cap screw which can be screwed into the bolt. Because the bolt and the elements attached thereto are mounted in the through bore in the panel so as to permit spherical pivoting motion, the bolt can pivot several degrees relative to the panel. It is obvious that the necessary pivoting motion occurs completely within the through bore in the panel and that a correspondingly large through bore is therefore required. If the through bore in the panel and the attachment bore in a wall or similar structure are misaligned as a result of construction tolerances, the bolt—and the foot of the bolt in particular—is inevitably inclined relative to the wall or similar structure, and flush contact between the foot of the bolt and the support structure cannot be guaranteed.

OBJECT OF THE INVENTION

The object of the current invention is to permit the eccentric arrangement of an attachment bolt which extends through a bore in a glass plate so that the barrel of the attachment bolt can be precisely aligned with the connected supporting or connecting element with a minimum of effort, thus essentially ensuring easy installation. The present invention is specifically intended for such joints in which the supporting element offers no or insufficient opportunity for tolerance compensation. This can be the case when, for example, glass doors are installed in curtain walls or attached to fixed walls or similar structures, i.e. whenever the barrel of an attachment bolt must be screwed into a blind bore, a dowel, etc.

A further object of the current invention is to ensure that tolerance compensation in all planes normal to the barrel axis is possible within the bore in the glass plate. Substantially, no other loose parts, such as eccentric clamping rings, etc., are required.

SUMMARY OF THE INVENTION

These objects can be achieved in a clamping mounting which can have a head with a basin-shaped recess into which the barrel fits; the recess can have an internal thread into which an adjusting nut for fixing the barrel can be screwed so that a retaining flange can be axially fixed between the bottom of the basin, the basin-shaped recess and the adjusting nut.

The present invention teaches that there can be a slot-like groove in which the retaining flange of the attachment bolt can be seated on that end of the adjusting nut facing the bottom of the basin in the head. The floor of this groove can form a support flange for the retaining flange and can have a slot which guides, and through which passes, the barrel of the attachment bolt. The solution as claimed by the current invention substantially eliminates the need for grooves on the retaining flange integrated into the barrel. Guiding the retaining groove in the slot-like groove in the adjusting nut can make it possible to laterally displace the adjusting nut and thus the head bolted to the adjusting nut in the direction of any of the four degrees of freedom by turning the adjusting nut to permit alignment with the bore in the glass plate on the one hand, and alignment with the position or orientation dictated by the barrel if the barrel has to be screwed into a dowel in a wall or a thread in a panel. The retaining flange of the barrel can be guided in the slot-like groove of the adjusting nut such that the barrel can still be moved in the direction of any of the four degrees of freedom even if the glass plate is firmly clamped between the adjusting nut and the head.

In other words, in one embodiment the present invention teaches that there is a slot-like groove on that end of the adjusting nut facing the bottom of the basin in the head. The retaining flange of the attachment bolt is seated in the slot-like groove. The floor of this groove forms a support flange for the retaining flange. The floor further has a slot cut in it which guides, and through which passes, the barrel of the attachment bolt. The groove can permit the adjusting nut and thus the head to be displaced along the length of the slot. The adjusting nut can also be rotated to therefore rotate the slot. The adjusting nut can also be axially displaced with respect to the bolt. This variety of movement can permit the adjusting nut and the head bolted to it to move in any of the four degrees of freedom, namely vertically, horizontally, axially, and rotationally with respect to the bolt. This freedom of motion can permit more accurate alignment with the position dictated by the barrel if the barrel has to be screwed into a dowel in a wall or a thread in a panel. The retaining flange of the barrel can be guided in the slot-like groove of the adjusting nut such that the barrel can still be moved substantially similarly to the adjusting nut as stated immediately above. The barrel can be moved relative to the adjusting nut in the direction of any of the four degrees of freedom even if the glass plate is firmly clamped between the adjusting nut and the head.

In one embodiment of the present invention, it is advantageous if that side of the adjusting nut opposite the slot-like groove is realized with some means of varying the distance between the clamping mounting and a wall or similar structure. This facilitates the positioning of a glass plate during installation, in particular the flush alignment of several adjacent plates.

To achieve this, one embodiment of the present invention can have an adjusting nut with an internal thread on that side opposite the slot-like groove, into which internal thread a distance bush having a corresponding external thread and a support plate can be screwed. This embodiment is advantageous when the distance between the glass plate and a supporting element, e.g. a wall, is relatively short.

As an alternative, another embodiment of the present invention teaches that the adjusting nut has an external thread on that side opposite the slot-like groove, onto which external thread a distance nut having a corresponding internal thread and a support flange for a distance bush can be screwed for when the distance between the glass plate and a supporting element, e.g. a wall or similar structure, is relatively great.

Both of the two preceding embodiments stated immediately above teach that the adjusting nut has a dual function. First, it stays or holds or positions the retaining flange of the attachment bolt and provides the connection to the head. Second, it provides the connection to a distance bolt or distance bush, the distance between which and the adjusting nut can vary.

The above discussed embodiments of the present invention will be described further hereinbelow with reference to the accompanying figures. When the word "invention" is used in this specification, the word "invention" includes "inventions," that is, the plural of "invention." By stating "invention," the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Two embodiments of the current invention are described in greater detail below with reference to the attached drawings, in which:

FIG. 1 is a sectional view along the line A—A shown in FIG. 2;

DESCRIPTION OF THE PREFERRED EMBODIMENT

Where appropriate, the same components of the two embodiments were assigned the same reference numbers.

Figure 1:
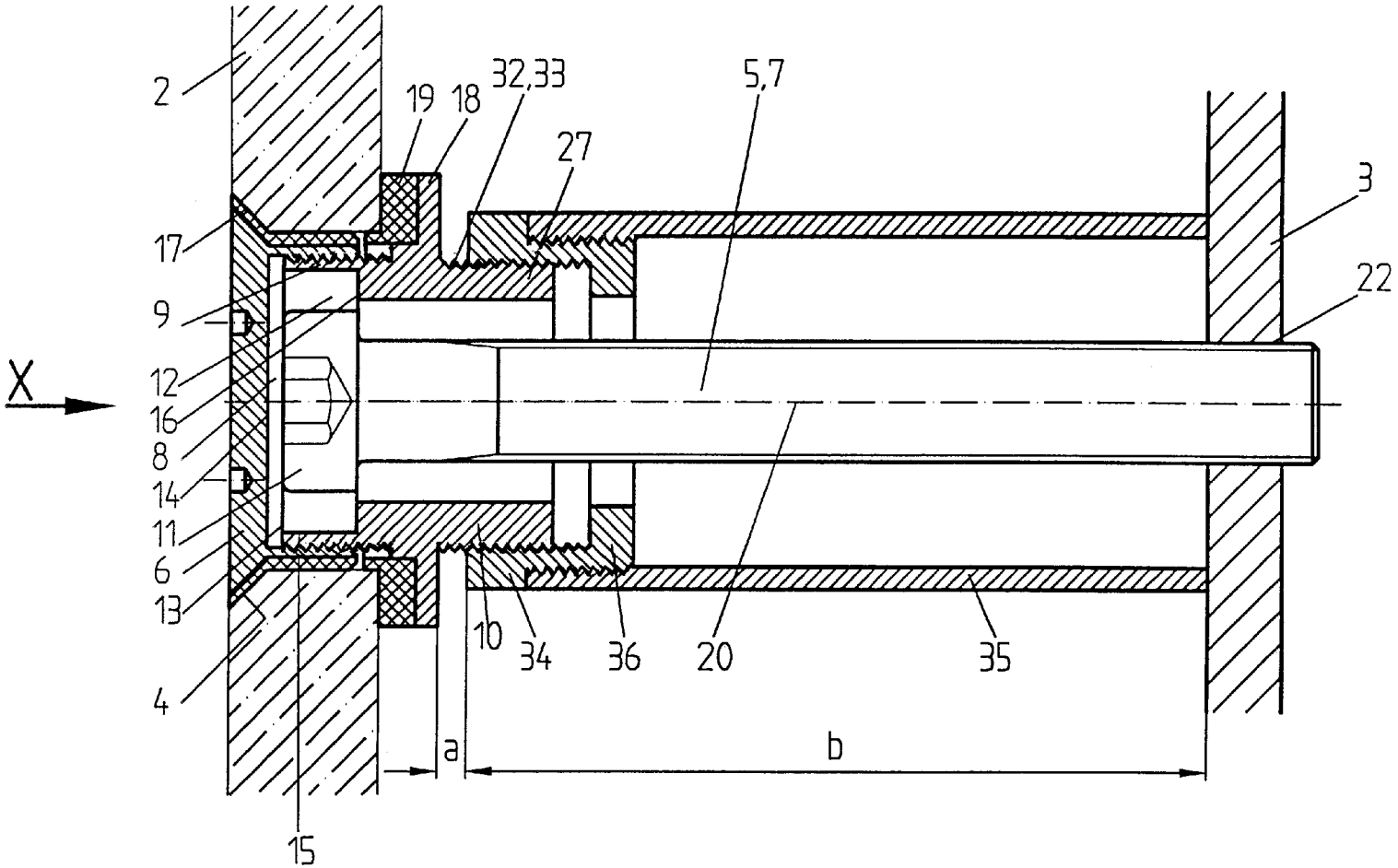
FIG. 1 shows a first embodiment of the present invention, whereby

As shown in FIG. 1, a clamping mounting is used to clamp a glass plate 2 and its attaching device to a wall 3. To this end, the glass plate 2 has a bore 4 in which bore 4 the head 6 of an attachment bolt 5 is seated, with a clamping ring 17 between the bore 4 and the head 6. The head 6 has a basin-shaped recess 8 with an internal thread 9 into which an adjusting nut 10 can be screwed. The adjusting nut 10 has a slot-like groove 15 (also see FIGS. 2 through 4) on that end facing the bottom 14 of the basin-shaped recess 8, i.e. near the end face 13 of the adjusting nut 10. There is a slot 25 (see FIGS. 2 and 3) in the floor 16 of the slot-like groove 15 through which the barrel 7 of the attachment bolt 5 passes. The circumference of the slot 15 is delimited by a support flange 21 (see FIG. 2), against which a retaining flange 11 of the barrel 7 of the attachment bolt 5 can rest. The play 12 of the barrel 7 in the slot 25 is particularly clear in FIGS. 2 through 4.

On the side of the glass plate 2 facing the wall 3, the adjusting nut 10 has a locating flange 18, between which flange 18 and the glass plate 2 and element 19 to protect the glass is located.

As shown in FIG. 1, there is an external thread 32 on that side 27 of the adjusting nut 10 opposite the slot 25, onto which a distance nut 36 with a corresponding internal thread 33 can be screwed. The distance nut 36 has a support flange 34 against which a distance bush 35 rests, the other end of which bush rests against the wall 3. The distance "a" between the distance nut 36 and the adjusting nut 10, and thus the distance "b" to the wall, can be varied via the distance nut 36 by turning the adjusting nut 10.

In at least one embodiment of the present invention, the distance "b" can be fixed due to the length of the distance bush 35. The total distance between the wall 3 and the glass plate 2 can be adjusted by or varied via the adjusting nut 10 and the distance nut 36.

Figures 2, 3, 4:
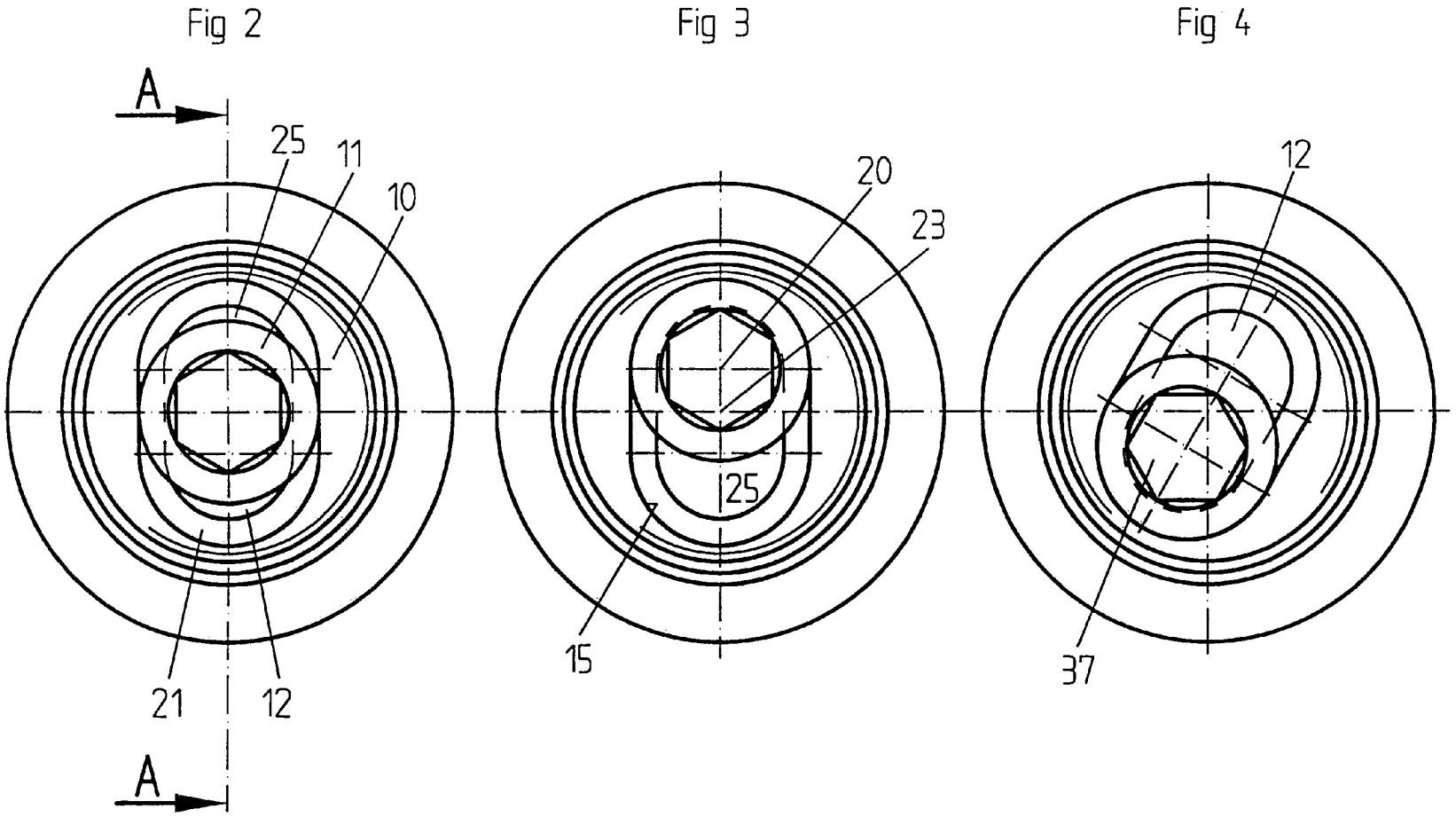
FIG. 2 shows a view of the embodiment shown in FIG. 1 in the direction of arrow X shown in FIG. 1, omitting the head.
FIG. 3 shows a view of the embodiment in FIG. 2 in a different installation position.
FIG. 4 shows a view of the embodiment in FIG. 2 in a different installation position.

As shown in FIGS. 2 and 3, the axis 20 of the attachment bolt 5 is aligned with the axis 23 of the adjusting nut 10 and thus the head 6. FIG. 3 shows a vertical deviation of the two axes 20 and 23, i.e. vertical axial displacement of the head 6 and adjusting nut 10 from the axis of the barrel 7.

FIG. 4 shows a corresponding diagonal displacement.

To further explain, FIG. 4 shows a vertical displacement similar to that of FIG. 3. The embodiment shown in FIG. 4 differs in that it can achieve an essentially diagonal displacement by combining the displacement of the adjusting nut 10 along the groove 15, with the ability of the adjusting nut 10 to be rotated, thus reorienting the groove 15 in a direction substantially diagonal with respect to the axis 20 of the bolt 5.

Figure 5:
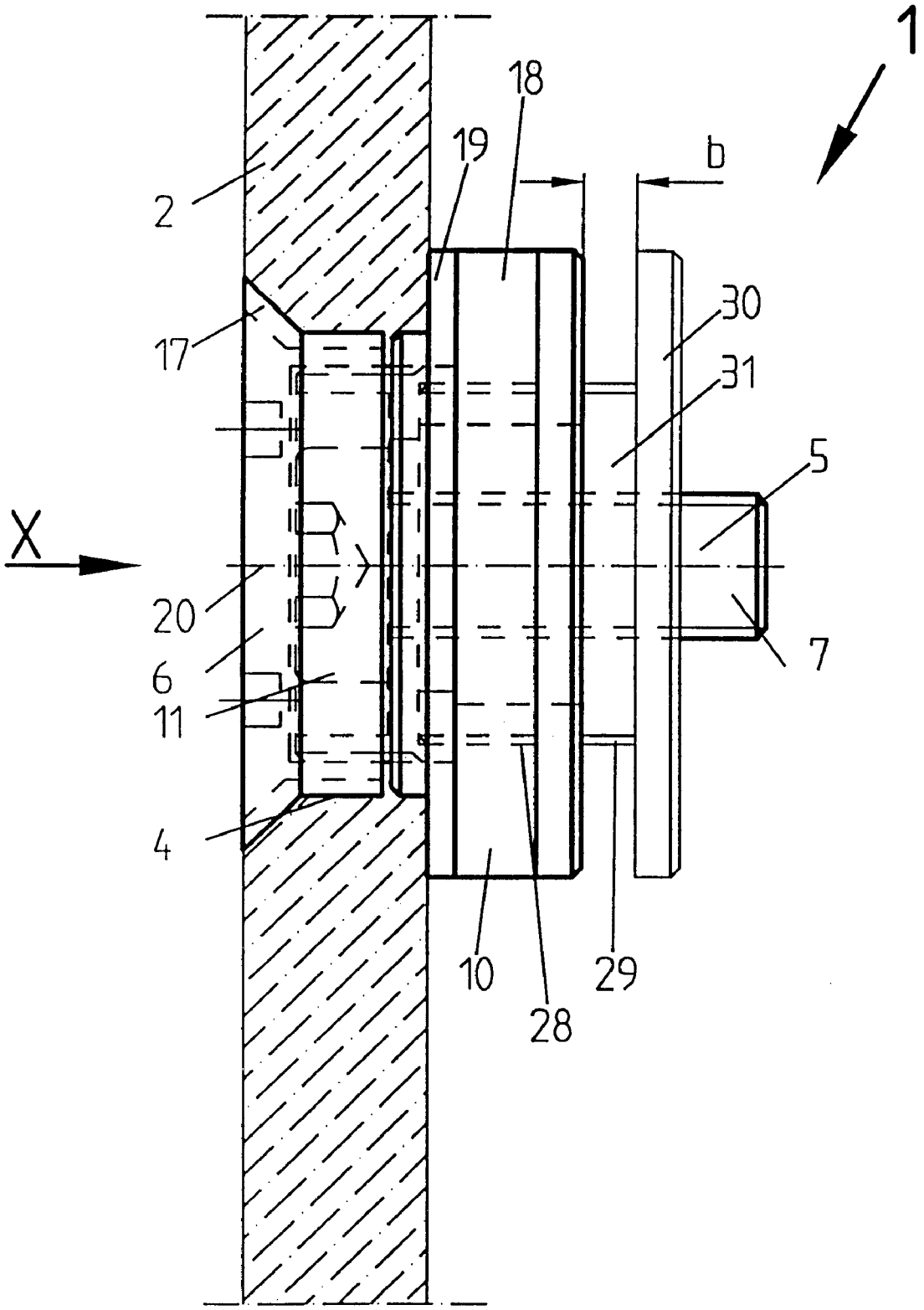
FIG. 5 shows a second embodiment of the present invention, which shows a side view of the clamping mounting in a section through the ring.

The embodiment shown in FIG. 5 essentially differs from that shown in FIG. 1 in that the adjusting nut 10 has on that side opposite the slot-like groove 15 (see FIG. 1) an internal thread 28, into which thread 28 a distance bolt 31 having a support plate 30 on its free end and an external thread 29 can be screwed. The clamping mounting 1 can rest with this support plate 30 directly against a supporting element, e.g. a wall 3. The distance "b" between the adjusting nut 10 and the distance bolt 31 can be varied here as well.

Figures 6, 7, 8:
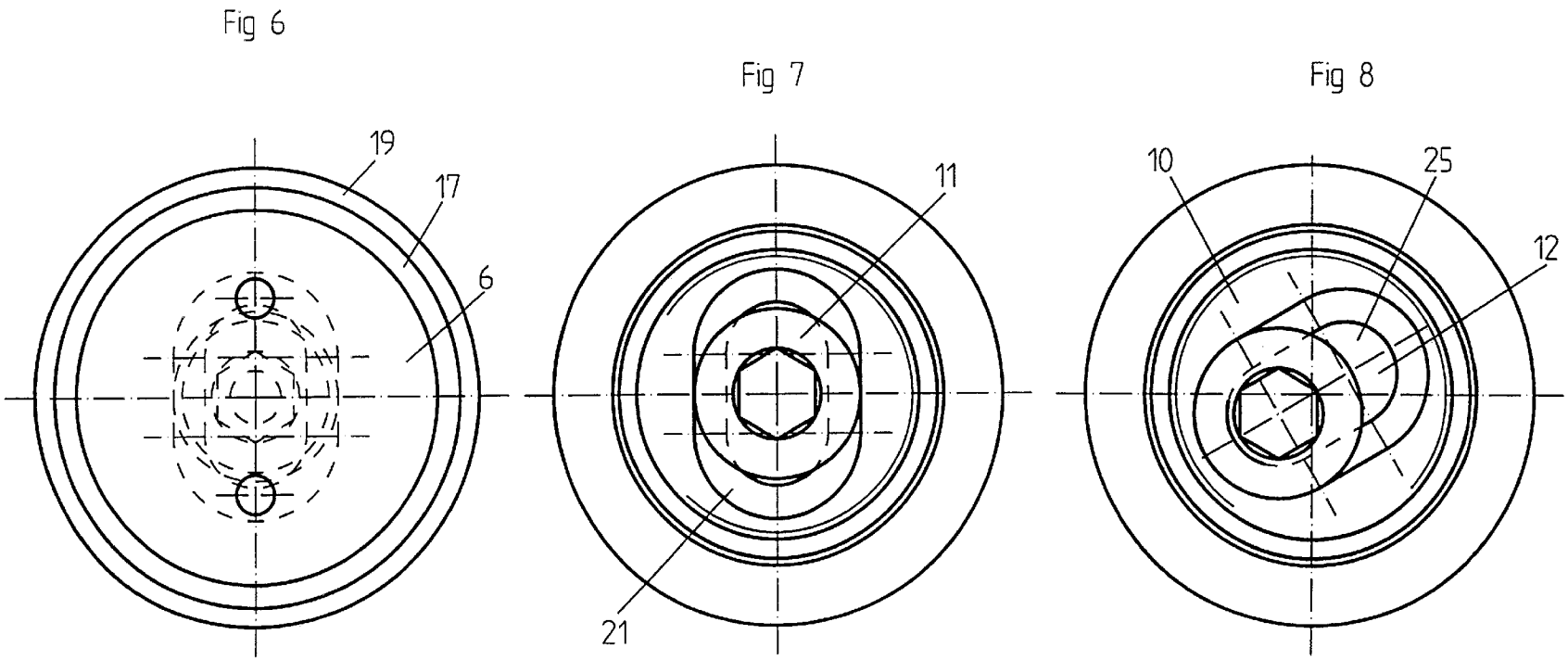
FIG. 6 shows a view of the embodiment shown in FIG. 5 in the direction of arrow X shown in FIG. 5.
FIG. 7 shows a view of the embodiment in FIG. 6 in a different installation position.
FIG. 8 shows a view of the embodiment in FIG. 6 in a different installation position.

FIG. 6 shows a view of the embodiment shown in FIG. 5 in the direction of arrow X. The head 6, clamping ring 17, and the glass-protecting element 19 are shown.

Similar to FIGS. 2 through 4, FIGS. 7 and 8 show a view in the direction of arrow X of various installation situations. Unlike FIG. 6, the head 6 has been omitted to show the arrangement of the support flange 21 and retaining flange 11 in FIG. 7, and the adjusting nut 10, slot 25, and play 12 in FIG. 8.

After placing the adjusting nut 10, to which the distance nut 36 is bolted, and the distance bush 35 on the barrel 7 of the attachment bolt 5, the attachment bolt 5 is screwed into a thread 22, a dowel, etc. in a wall via a hexagon socket 37 (see FIG. 4). Once an element 19 to protect the glass is put in place, the adjusting nut 10 and its associated components (distance nut 36, distance bush 35) are displaced by displacing the slot-like groove 15 relative to the barrel 7 of the attachment bolt 5 so that the axis 23 of the adjusting nut 10 and thus the axis of the head 6 is aligned with the axis of the bore 4 in the glass plate 2. The attachment bolt 5 can then be braced against the wall 3 as desired, i.e. at the desired distance to the wall using the distance nut 36. The glass plate 2 is positioned by changing the depth to which the attachment bolt 5 is screwed in on the one hand, and on the other hand by bracing the retaining flange 11 with the adjusting nut 10 via the distance nut 36, with the distance bush 35 resting against the wall 3. The glass plate 2 is fixed by bolting the head 6 down to the adjusting nut 10, with the clamping ring 17 between the two. The retaining flange 11 of the attachment bolt 5 rests against the support flange 21 of the slot-like groove.

In other words, in one embodiment of the present invention, the adjusting nut 10 can be bolted to the distance nut 36 by the corresponding threads. The distance bush 35 can then be screwed onto the distance nut 36 and adjusted for the desired distance from the wall 3. The attachment bolt 5 can then be slid through the slot 25 in the adjusting nut 10 and screwed into a thread 22, a dowel, etc. in a wall via a hexagon socket 37. Once an element 19 to protect the glass is put in place, the adjusting nut 10 and its associated components (distance nut 36, distance bush 35) can be displaced by displacing the slot-like groove 15 relative to the barrel 7 of the attachment bolt 5 so that the axis 23 of the adjusting nut 10 and thus the axis of the head 6 is aligned with the axis of the bore 4 in the glass plate 2. The attachment bolt 5 can then be braced against the wall 3 as desired, i.e. at the desired distance to the wall using the distance nut 36. The glass plate 2 is positioned by changing the depth to which the attachment bolt 5 is screwed in on the one hand, and on the other hand by bracing the retaining flange 11 with the adjusting nut 10 via the distance nut 36, with the distance bush 35 resting against the wall 3. The glass plate 2 is finally fixed by bolting the head 6 down to the adjusting nut 10, with the clamping ring 17 between the glass plate 2 and the head 6. The retaining flange 11 of the attachment bolt 5 rests against the support flange 21 of the slot-like groove.

The clamping mounting shown in FIG. 5 is installed in a similar manner.

On feature of the invention resides broadly in the clamping mounting for glass plates having an attachment bolt which passes through a bore in the glass plate and which attachment bolt has a head and a barrel, whereby the head and the barrel are realized as separate components and the barrel can be fixed to the head such that the barrel can be displaced perpendicular to the barrel axis in any of the four degrees of freedom, and whereby the head comprises a conical nut located within the bore in the glass plate and an adjusting nut which can be screwed into the internal thread of the conical nut, and the head forms a basin-shaped recess for seating the barrel, which barrel has on that end inserted into the basin-shaped recess a retaining flange located between the adjusting nut and the basin bottom of the conical nut, characterized by the fact that the adjusting nut 10 has on that end face 13 facing the bottom 14 of the basin in the head 6 a slot-like groove 15 in which the retaining flange 11 of the attachment bolt 5 is seated, the floor 15 of which groove forms a support flange 21 for the retaining flange 11 and has a slot 25 which guides, and through which passes, the barrel 7 of the attachment bolt 5.

Another feature of the invention resides broadly in the clamping mounting characterized by the fact that the adjusting nut 10 has on that side 27 opposite the slot-like groove 15 some means for fixing the clamping mounting at a variable distance to a wall 3 or similar supporting element.

Yet another feature of the invention resides broadly in the clamping mounting characterized by the fact that the adjusting nut 10 has on that side 27 opposite the slot-like groove 15 an internal thread 28, into which a distance bolt 31 having a support plate 30 and a corresponding external thread can be screwed.

Still another feature of the invention resides broadly in the clamping mounting characterized by the fact that the adjusting nut 10 has on that side 27 opposite the slot-like groove 15 an external thread 32 onto which a distance nut 36 having a corresponding internal thread 33 and a support flange 34 for a distance bush 35.

Some examples of glass mountings or glass mounting devices which may possibly be utilized or adapted for use in the context of the present invention may be found in the following U.S. Pat. Nos. 5,323,577, issued on Jun. 28, 1994 to Whitmyer; 5,283,978, issued on Feb. 8, 1994 to Horgan, Jr.; 5,212,922, issued on May 25, 1993 to Werner; 4,841,697, issued on Jun. 27, 1989 to Hogg, et al.; 4,097,320, issued on Jun. 27, 1978 to Brauer et al.; 4,054,268, issued on Oct. 18, 1977 to Sher; and 4,016,690, issued on Apr. 12, 1997 to Richardson.

Some examples of glass facades and methods of securing glass panels of a facade which may possibly be utilized or adapted for use in the context of the present invention may be found in the following U.S. Pat. Nos. 5,493,831, issued on Feb. 27, 1996 to Jansson; 5,301,484, issued on Apr. 12, 1994 to Jansson; 4,837,996, issued on Jun. 13, 1989 to Eckelt; and 4,793,112, issued on Dec. 27, 1988 to Sufke.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 197 13 038.0, filed on Mar. 27, 1997, having inventor Ernst Udo Blöbaum, and DE-OS 197 13 038.0 and DE-PS 197 13 038.0 and International Application No. PCT/EP98/01705, filed on Mar. 24, 1998, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

AT LEAST PARTIAL REFERENCE NUMBERS

1. Clamping mounting
2. Glass plate
3. Wall
4. Bore
5. Attachment bolt
6. Head
7. Barrel
8. Basin-shaped recess
9. Internal thread
10. Adjusting nut
11. Retaining flange
12. Play
13. End face of adjusting nut
14. Bottom of the basin
15. Slot-like groove
16. floor of groove
17. Clamping ring
18. Locating flange
19. Element to protect the glass
20. Axis
21. Support flange
22. Thread
23. Axis
25. Slot
26. Clamping ring
27. Side of adjusting nut
28. Internal thread
29. External thread
30. Support plate
31. Distance bolt
32. External thread
33. Internal thread
34. Support flange
35. Distance bush
36. Distance nut
37. Hexagon socket X Direction
a distance
b distance

What is claimed is:

1. A kit to construct a clamping mounting to permit mounting glass plates having misaligned holes, said kit comprising:

an attachment bolt;

said bolt having a length dimension;

said bolt having a center axis;

the axis of said bolt being disposed to run parallel to said length dimension;

said bolt comprising a first end portion and a second end portion;

said second end portion of said bolt being disposed opposite said first end portion of said bolt;

said second end portion of said bolt being configured to be connected to a supporting structure;

a bolting arrangement being configured to bolt a glass plate to a supporting structure;

said bolt arrangement comprising an adjusting device;

said adjusting device being configured to pass through a hole in a glass plate;

said adjusting device being configured to be disposed adjacent to and configured to be connected to said first end portion of said bolt;

said adjusting device comprising an end section;

said first end portion of said bolt comprising a retaining portion;

said retaining portion being configured to be disposed immediately adjacent and configured to be connected to said end section of said adjusting device;

said end section of said adjusting device comprising a slot structure;

said slot structure having a length dimension and a width dimension;

said length dimension being longer than said width dimension;

said slot structure comprising an orifice;

said orifice having a length and a width;

said length of said orifice being longer than said width of said orifice;

said orifice being dimensioned to permit said bolt to pass through said slot structure and to permit movement of the location of said bolt within said slot structure;

said adjusting device being rotatable to permit said slot structure to rotate within a hole in a glass plate;

a clamping element to clamp a glass plate to said adjusting device;

said clamping element being configured and disposed to connect to said adjusting device through a hole in a glass plate; and said adjusting device being configured to be displaceable to permit said slot structure to be displaced with respect to said bolt to permit said adjusting device to be displaced to align with a hole in a glass plate misaligned with the axis of said bolt.

2. The kit according to claim 1, wherein:

said bolting arrangement comprises a distance varying structure, said distance varying structure being configured to permit variation of distance between said adjusting device and a supporting structure;

said distance varying structure is configured to be disposed adjacent to and connected to said adjusting device to permit said adjusting device to be axially displaceable with respect to the axis of said bolt; and said distance varying structure is configured to be displaceable to permit said adjusting device to be displaced transversely to the axis of said bolt to permit said distance varying structure to be displaced transversely.

3. The kit according to claim 2, wherein:

said slot structure comprises a groove disposed about said orifice; and said retaining device is configured to be seated in said groove.

4. The kit according to claim 3, wherein:

said retaining device comprises a retaining flange;

said retaining flange has a diameter; and said diameter of said retaining flange is substantially the same as said width of said slot structure.

5. The kit according to claim 4, wherein:

said groove comprises a floor;

said floor comprises a supporting flange for said retaining flange; and said supporting flange is disposed about said orifice.

6. The kit according to claim 5, wherein:

said clamping element comprises a head;

said adjusting device comprises an adjusting nut;

said head comprises a basin-shaped recess;

said adjusting nut is configured to be inserted into said recess and connected to said head.

7. The kit according to claim 6, wherein:

said end section of said adjusting device comprises an end face;

said recess comprises a bottom; and said bottom is configured and disposed in said recess to face said end face of said adjusting nut.

8. The kit according to claim 7, wherein:

said adjusting nut comprises a threaded portion;

said distance varying structure comprises a threaded portion; and said threaded portion of said adjusting nut is configured to mesh with said threaded portion of said distance varying structure.

9. The kit according to claim 8, wherein:

said distance varying structure comprises:

a distance nut;

said distance nut is configured to axially adjust the space between said adjusting nut and a supporting structure;

a distance bush;

said distance bush is configured to be disposed to rest between said distance nut and a supporting structure, such as a wall, to provide space between said adjusting nut and a supporting structure;

said distance nut comprises a holding flange;

said holding flange is configured to be disposed to rest against said distance bush;

said threaded portion of said distance varying device comprises a threaded portion of said distance nut;

said threaded portion of said adjusting nut is disposed on the exterior of said adjusting nut;

said threaded portion of said distance nut is configured to mesh with said threaded portion of said adjusting nut; and said threaded portion of said distance nut is disposed on the interior of said distance nut to permit said adjusting nut to be screwed into said distance nut to permit axial movement of said adjusting nut with respect to said bolt to permit adjustment of space between said adjusting nut and a supporting structure.

10. The kit according to claim 8, wherein:

said distance varying structure comprises a spacing bolt to provide space between said adjusting nut and a supporting structure;

said spacing bolt comprises a support plate;

said threaded portion of said distance varying device comprises a threaded portion of said spacing bolt;

said threaded portion of said adjusting nut is disposed on the interior of said adjusting nut;

said threaded portion of said spacing bolt is configured to mesh with said threaded portion of said adjusting nut; and said threaded portion of said spacing bolt is disposed on the exterior of said spacing bolt to permit said adjusting device to be screwed around said spacing bolt to permit axial movement of said adjusting device with respect to said bolt to permit adjustment of space between said adjusting device and a supporting structure.

11. The kit according to claim 10, wherein:

said attachment bolt is configured to be fixed to said head whereby said attachment bolt is displaceable tansversely to the axis of said attachment bolt;

said first end portion of said bolt is seated in said recess of said head;

said head comprises a conical nut;

said conical nut comprises an internal thread;

said adjusting nut comprises an external thread;

said internal thread of said conical nut is configured to mesh with said external thread of said adjusting nut;

said adjusting nut is configured to be screwed into said conical nut; and said retaining flange is configured to be disposed between said bottom of said recess and said adjusting nut.

12. A method of using a kit to construct a clamping mounting to mount glass plates having misaligned holes, said kit comprising: an attachment bolt; said bolt having a length dimension; said bolt comprising a center axis; the axis of said bolt being disposed to run parallel to said length dimension; said bolt comprising a first end portion and a second end portion; said second end portion of said bolt being disposed opposite said first end portion of said bolt; said second end portion of said bolt being configured to be connected to a supporting structure; a bolting arrangement being configured to bolt a glass plate to a supporting structure; said bolting arrangement comprising an adjusting device; said adjusting device being configured to pass through a hole in a glass plate; said adjusting device being configured to be disposed adjacent to and configured to be connected to said first end portion of said bolt; said adjusting device comprising an end section; said first end portion of said bolt comprising a retaining portion; said retaining portion being configured to be disposed immediately adjacent and configured to be connected to said end section of said adjusting device; said end section of said adjusting device comprising a slot structure; said slot structure having a length dimension and a width dimension; said length dimension being longer than said width dimension; said slot structure comprising an orifice; said orifice being dimensioned to permit said bolt to pass through said slot structure and to permit movement of the location of said bolt within said slot structure; said adjusting device being rotatable to permit said slot structure to rotate within a hole in a glass plate; a clamping element to clamp a glass plate to said adjusting device; said clamping element being configured and disposed to connect to said adjusting device through a hole in a glass plate; and said adjusting device being configured to be displaceable to permit said slot structure to be displaced with respect to said bolt to permit said adjusting device to be displaced to align with a hole in a glass plate misaligned with the axis of said bolt; said method comprising the steps of:

sliding said bolt through said orifice in said slot structure of said adjusting device;

connecting said second end portion of said bolt to a supporting structure;

connecting said retaining portion of said bolt to said adjusting device;

said displacing of said slot structure comprises rotating said adjusting device to rotate said slot structure into a desired orientation with respect to the axis of said bolt;

displacing said slot structure with respect to said bolt to move the location of said bolt within said slot structure and to displace said adjusting device with respect to said bolt in order to align said adjusting device with a hole in a glass plate misaligned with the axis of said bolt; and clamping a glass plate to said adjusting device with said clamping element by connecting said clamping element to said adjusting device.

13. The method according to claim 12 of using a kit to construct a clamping mounting to mount glass plates having misaligned holes, wherein: said bolting arrangement comprises a distance varying structure being configured to permit variation of distance between said adjusting device and a supporting structure; and said distance varying structure is configured to be disposed adjacent to and connected to said adjusting device to permit said adjusting device to be axially displaceable with respect to the axis of said bolt; said method further comprising the steps of:

connecting said adjusting device to said distance varying structure; and axially displacing said adjusting device to vary distance between said adjusting device and a supporting structure.

14. A clamping mounting to mount glass plates having misaligned holes, said clamping mounting comprising:

an attachment bolt;

said bolt having a length dimension;

said bolt comprising a center axis;

the axis of said bolt being disposed parallel to said length dimension;

said bolt comprising a first end portion and a second end portion;

said second end portion of said bolt being disposed opposite said first end portion of said bolt;

said second end portion of said bolt being connected to a supporting structure;

a bolting arrangement bolting a glass plate to a supporting structure;

said bolting arrangement comprising an adjusting device;

said adjusting device passing through a hole in a glass plate;

said adjusting device being disposed adjacent to and connected to said first end portion of said bolt;

said adjusting device comprising an end section;

said first end portion of said bolt comprising a retaining portion;

said retaining portion being disposed immediately adjacent and connected to said end section of said adjusting device;

said end section of said adjusting device comprising a slot structure;

said slot structure having a length dimension and a width said length dimension being longer than said width dimension;

said slot structure comprising an orifice;

said orifice permitting said bolt to pass through said slot structure and permitting movement of the location of said bolt within said slot structure;

said adjusting device being rotatable to rotate said slot structure within a hole in a glass plate;

a clamping element to clamp a glass plate to said adjusting device;

said clamping element being connected to said adjusting device through a hole in a glass plate; and said adjusting device being displaceable to displace said slot structure with respect to said bolt to displace said adjusting device to align with a hole in a glass plate misaligned with the axis of said bolt.

15. The clamping mounting according to claim 14, wherein:

said bolting arrangement comprises a distance varying structure permitting variation of distance between said adjusting device and a supporting structure;

said distance varying structure is disposed adjacent to and connected to said adjusting device to permit said adjusting device to be axially displaceable with respect to the axis of said bolt; and said distance varying structure is displaceable to displace said adjusting device transversely to the axis of said bolt to displace said distance varying structure transversely.

16. The clamping mounting according to claim 15, wherein:

said slot structure comprises a groove disposed about said orifice; and said retaining device is seated in said groove.

17. The clamping mounting according to claim 16, wherein:

said retaining device comprises a retaining flange;

said retaining flange has a diameter;

said diameter of said retaining flange is substantially the same as said width of said slot structure;

said groove comprises a floor;

said floor comprises a supporting flange for said retaining flange;

said supporting flange is disposed about said orifice;

said clamping element comprises a head;

said adjusting device comprises an adjusting nut;

said head comprises a basin-shaped recess;

said adjusting nut is inserted into said recess and connected to said head;

said end section of said adjusting device comprises an end face;

said recess comprises a bottom; and said bottom is disposed in said recess facing said end face of said adjusting nut.

18. The clamping mounting according to claim 17, wherein:

said adjusting nut comprises a threaded portion;

said distance varying structure comprises a threaded portion; and said threaded portion of said adjusting nut is meshed with said threaded portion of said distance varying structure.

19. The clamping mounting according to claim 18, wherein:

said distance varying structure comprises:

a distance nut;

said distance nut is axially adjustable to adjust the space between said adjusting nut and a supporting structure;

a distance bush;

said distance bush is disposed resting between said distance nut and a supporting structure, such as a wall, providing space between said adjusting nut and a supporting structure;

said distance nut comprises a holding flange;

said holding flange is disposed resting against said distance bush;

said threaded portion of said distance varying device comprises a threaded portion of said distance nut;

said threaded portion of said adjusting nut is disposed on the exterior of said adjusting nut;

said threaded portion of said distance nut is meshed with said threaded portion of said adjusting nut; and said threaded portion of said distance nut is disposed on the interior of said distance nut to screw said adjusting nut into said distance nut to axially move said adjusting nut with respect to said bolt to adjust space between said adjusting nut and a supporting structure.

20. The clamping mounting according to claim 18, wherein:

said distance varying structure comprises a spacing bolt to provide space between said adjusting nut and a supporting structure;

said spacing bolt comprises a support plate;

said threaded portion of said distance varying device comprises a threaded portion of said spacing bolt;

said threaded portion of said adjusting nut is disposed on the interior of said adjusting nut;

said threaded portion of said spacing bolt is meshed with said threaded portion of said adjusting nut; and said threaded portion of said spacing bolt is disposed on the exterior of said spacing bolt to screw said adjusting device around said spacing bolt to axially move said adjusting device with respect to said bolt to adjust space between said adjusting device and a supporting structure.

* * * * *

UNITED STATES PATENT AND TRADEMARK OFFICE

CERTIFICATE OF CORRECTION

PATENT NO. : 6,158,177
DATED : December 12, 2000
INVENTOR(S) : Ernst Udo Blöbaum It is certified that error appears in the above-identified patent and that said Letters Patent is hereby corrected as shown below:

Column 12, claim 14,
Line 54, after "width" insert -- dimension; --.

Signed and Sealed this

Sixteenth Day of April, 2002

*Attest:*

*Attesting Officer*

JAMES E. ROGAN
*Director of the United States Patent and Trademark Office*